US005355645A

United States Patent [19]

Farag

[11] Patent Number: 5,355,645

[45] Date of Patent: Oct. 18, 1994

[54] STOPLESS BUTT-JOINT MULTIPLE CURTAINWALL SYSTEM

[76] Inventor: F. Aziz Farag, 43 N. Juliet St., Iselin, N.J. 08830

[21] Appl. No.: 936,048

[22] Filed: Aug. 26, 1992

[51] Int. Cl.[5] ..... E04C 2/46

[52] U.S. Cl. ..... 52/235; 52/788; 52/730.5

[58] Field of Search ..... 52/235, 787, 788, 790, 52/730.3, 730.5, 397, 398, 400, 401; 49/DIG. 1

[56] References Cited

U.S. PATENT DOCUMENTS

| | | | |
|---|---|---|---|
| 3,112,534 | 12/1963 | Winnan | 52/401 |
| 3,734,550 | 5/1973 | Vance | 52/235 |
| 4,021,987 | 5/1977 | Schnebel et al. | 52/495 |
| 4,207,717 | 6/1980 | Hubbard | 52/235 |
| 4,552,790 | 11/1985 | Francis . | |
| 4,633,631 | 1/1987 | Crandell | 52/399 |
| 4,650,702 | 3/1987 | Whitmyer | 428/31 |
| 4,686,805 | 8/1987 | Forslin | 52/208 |
| 4,724,637 | 2/1988 | Evans . | |
| 4,738,065 | 4/1988 | Crandell | 52/235 |
| 4,799,344 | 1/1989 | Francis . | |
| 4,803,817 | 2/1989 | White et al. . | |
| 4,809,475 | 3/1989 | Emmer | 52/235 |
| 4,815,245 | 3/1989 | Gartner | 52/171 |
| 4,817,351 | 4/1989 | Michlovic . | |
| 4,837,996 | 6/1989 | Eckelt . | |
| 4,841,700 | 6/1989 | Matthews . | |
| 4,905,435 | 3/1990 | Horst . | |
| 4,912,898 | 4/1990 | Holmes . | |
| 5,014,477 | 5/1991 | MacDonald | 52/235 |
| 5,094,051 | 3/1992 | Miller | 52/235 |
| 5,199,236 | 4/1993 | Allen | 52/235 |

*Primary Examiner*—Carl D. Friedman
*Assistant Examiner*—Kien Nguyen
*Attorney, Agent, or Firm*—Oliff & Berridge

[57] ABSTRACT

A system and method is employed for installing a curtainwall thermally broken multi-system of four sided stopless butt-joint glazing or facing panels with dry gasketted joints. A retainer clip assembly attaches facing panels of glass, metal, granite, marble, plastic, acrylic, insulation or the like of single, multiple or composite panels. The curtain wall multi-system can have an irregular geometric impression. All field labor for initial installation or replacement takes place from inside the building. A supporting metal grid can include split mullion interlocking halves which are anchored to the building's structure. A retainer clip assembly reduces tension stress and insures a fail-safe thermal break system. Glass, facing panel, louver infills, framed operable window in one plane or multiple planes, dual glazing of glass, acrylic sheets or any combination thereof can be used with the grid. In other embodiment, thermal break spacers are positioned between interlocking portions of a mullion.

24 Claims, 14 Drawing Sheets

STOPLESS BUTT-JOINT MULTIPLE CURTAINWALL SYSTEM

The subject matter of this application is related to the subject matter of copending application Ser. No. 07/869,765, filed Apr. 16, 1992.

BACKGROUND OF THE INVENTION

1. Field of the Invention

The invention relates to an apparatus and method for forming multiple shapes of curtainwall in general, and in particular, stopless butt-joint curtain walls having thermal breaks therein.

2. Description of the Related Art

Modern buildings often have continuous exterior facing panel areas extending around the building exterior. These panel areas can include panels of glass, metal, plastic, granite and the like of single, multiple or composite construction. The panels can be supported by either direct or indirect attachment. In indirect attachment, a building's supporting structural framework is used to support non-bearing walls. These non-bearing exterior walls with metal gridded substructure are referred to as curtainwalls. The problem of easily and permanently installing curtainwalls or replacing glass, facing panels or infills without: 1) exterior stops at the four sides of glass and other facing panels; 2) a thick front width of members known as the "sight line", which may show beyond the stopless glass; 3) glass secured with structural silicone sealant adhesion; 4) the use of an exterior scaffold for exterior application or access to joints; 5) the use of extra metal and elements for providing extruded covers for inside the member central structural element; 6) extensive field labor; 7) wet caulking weather seal field application; 8) high cost of custom engineered adapters and retainers for installing different facing panels, infill or framed operable windows, with different thickness, or located in a different face plane; 9) the chance for air and water infiltration through extra joints because of the use of additional adapters and retainers; 10) high cost when different curtainwall systems are used in different locations of the same building for changing appearance or depth of curtainwall mullions; and 11) the possibility of failure of an integrated structural thermal break when subjected to tension stress, has persisted in the curtainwall community, and these considerations are advantages of this present invention.

One conventional solution for providing a stopless glazing curtainwall is to provide a structural sealant between glass panels and metal members of supporting frame. U.S. Pat. No. 4,552,790 describes an approach for providing a unit that can be glazed without exterior stops or caps using structural sealant. Glass plates are joined with a spacer to seal the edges of the insulated glass panels. Structural sealant is used on two opposite sides of the spacer to bind the spacer to an adjacent inside surface of the glass plate. Application of the structural sealant is performed from the exterior of the building.

U.S. Pat. No. 4,724,637 describes an approach for interior installation of panels with a system for two sided vertical butt glaze. In this system, a factory glazed and assembled frame is insertable between head and sill liners from the building interior. The head and sill liners are visible from the exterior of the building. The glass panels are bonded to a portion of the frame by structural silicone. The use of structural silicone has the disadvantage of being a relatively expensive material. Further, the application of structural silicone to glass panels requires extensive labor, quality assurance and testing. Also, it is not clear how the glass panels would be replaced.

U.S. Pat. No. 4,912,898 describes an approach for providing a curtainwall having a smooth outer surface which is rail free. A curtainwall which is rail free requires butt joints having sufficient strength to hold the panels in place. This patent describes a butt joint which combines both an adhesive with a bracket to securely hold the panels in place. In this system access from outside the building is needed to install the panels.

U.S. Pat. No. 4,841,700 describes a narrow flush glazed framing system for curtainwalls including thermal breaks. A pair of vertical mullions define the outer boundaries of the framing system. Dual panels of glass are supported between the vertical mullions. A vertical intermediate mullion has a deep glazing channel and a slot for forming a shallow glazing channel. A thermal break is positioned in the deep glazing channel and a thermal break filler assembly fits into the slot to form the shallow glazing channel. The thermal break filler assembly includes a thermal break filler element snap fit between a pair of filler halves to form a three piece filler assembly. The thermal break filler assembly makes it possible to reduce the visible mullion face dimension without reducing the depth of the glazing channels of the mullion.

SUMMARY OF THE INVENTION

Briefly described, this present invention comprises a curtainwall multi-system with dry gasket installation. The curtainwall system can include forming an irregular geometric impression to the observer by the combination of various four sided stopless butt-joint glass or facing panels of metal, granite, marble, or insulation. Facing panels can be single, multiple or composite panels in one or multiple face planes. These panels are mechanically secured and supported by means of hook retainer clip assembly.

Field labor for initial installation or replacement of glass or facing panels takes place completely from inside the building. This installation comprises mechanically securing the hook clip retainer assembly to a preassembled grid. The grid includes vertical mullions. Vertical mullions can be split interlocking mullion halves which are anchored to the building's structure. Premolded thermal break and a primary integrated structural thermal break can be part of the grid and together with the tension relieving clip provides a fail safe thermal break system.

Preferably, the hook retainer clip assembly includes a hook clip and a bracket retainer which are snapped together. A pair of guide flanges can be used to guide the bracket retainer into engagement with the hook clip. Various shaped hook retainer clip assemblies provide the ability for installing framed operable windows, louvers, sandwiched thick insulation panels, infill panels of varying widths, or the like. Dual glazed of glass, laminated glass, tempered glass or acrylic sheets or any combination thereof can also be used with the hook retainer clip assembly.

DETAILED DESCRIPTION OF THE PREFERRED EMBODIMENT

During the course of the description like numbers will be used to identify like elements according to the different figures which illustrate the invention.

Figure 1:
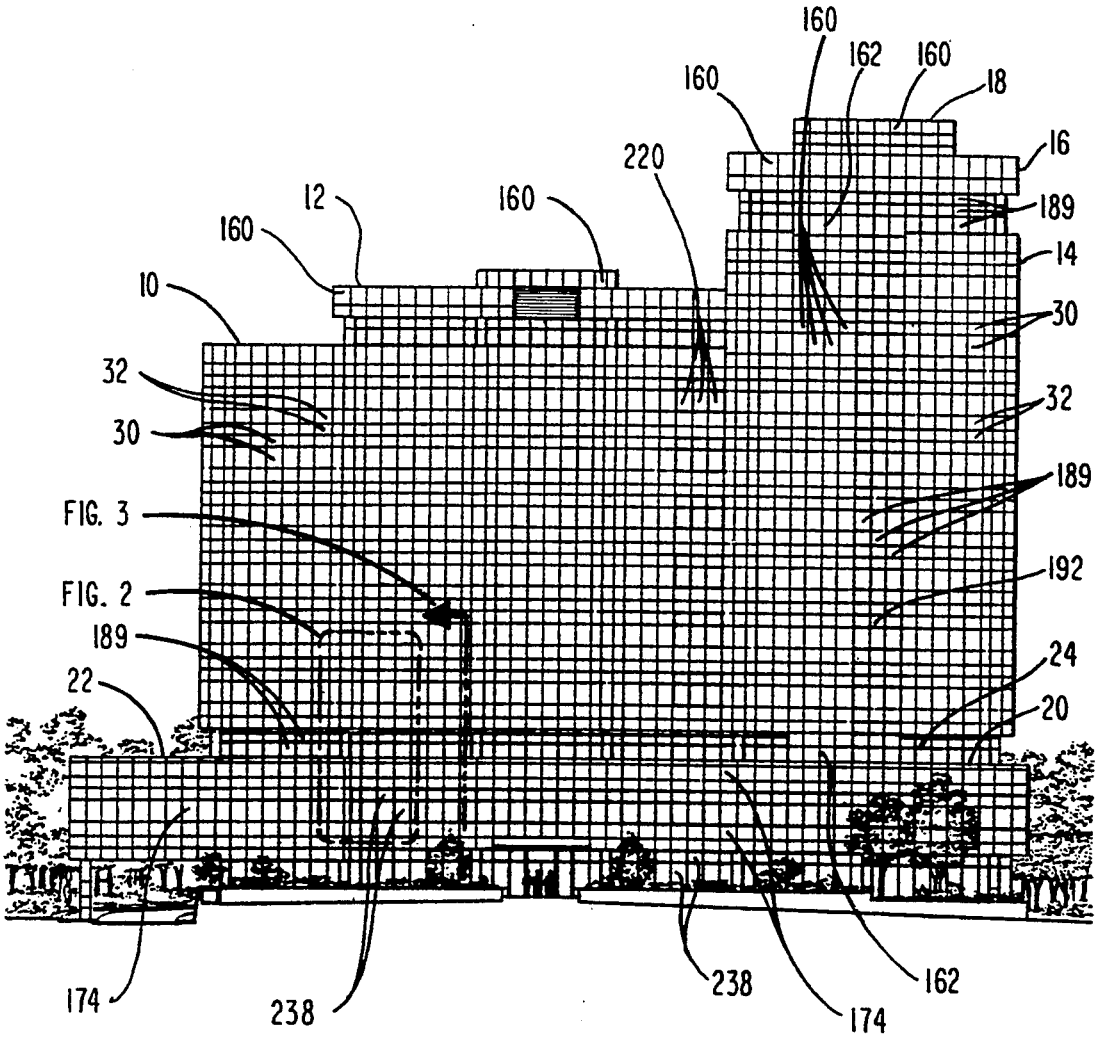
FIG. 1 is a front elevational view of a building facade of the first embodiment of the invention.

FIG. 1 is a front elevational view of a building facade of the preferred embodiment of the invention. Multiple blocks form the exterior of the building. In this embodiment, the building includes an upper angle shaped building with two perpendicularly connected wing blocks. Preferably, each wing block has a different height. Upper left wing block 10 has typical floors and a recessed top floor 12. Upper right wing block 14 has typical floors and a recessed top floor 16. A utility room 18 is positioned above recessed top floor 16. Wing blocks 10 and 14 are located on top of a lower base block 20. A recessed floor 24 is positioned between lower base block 20 and wing blocks 10 and 14. Base block 20 including a projected left portion 22.

Each floor of upper blocks 10 and 14 preferably has two tiers of insulated glass panels 30 installed side by side. The horizontal blocked vision strip at each floor slab and beam is two tiers of single spandrel glass 32. The two tiers of spandrel glass 32 are installed side by side for blocking the vision area between floors. An enclosure strip 162 can also be exposed to the observer. Preferably, the different blocks are formed of different facade materials for creating different graphic impressions.

Figure 2:
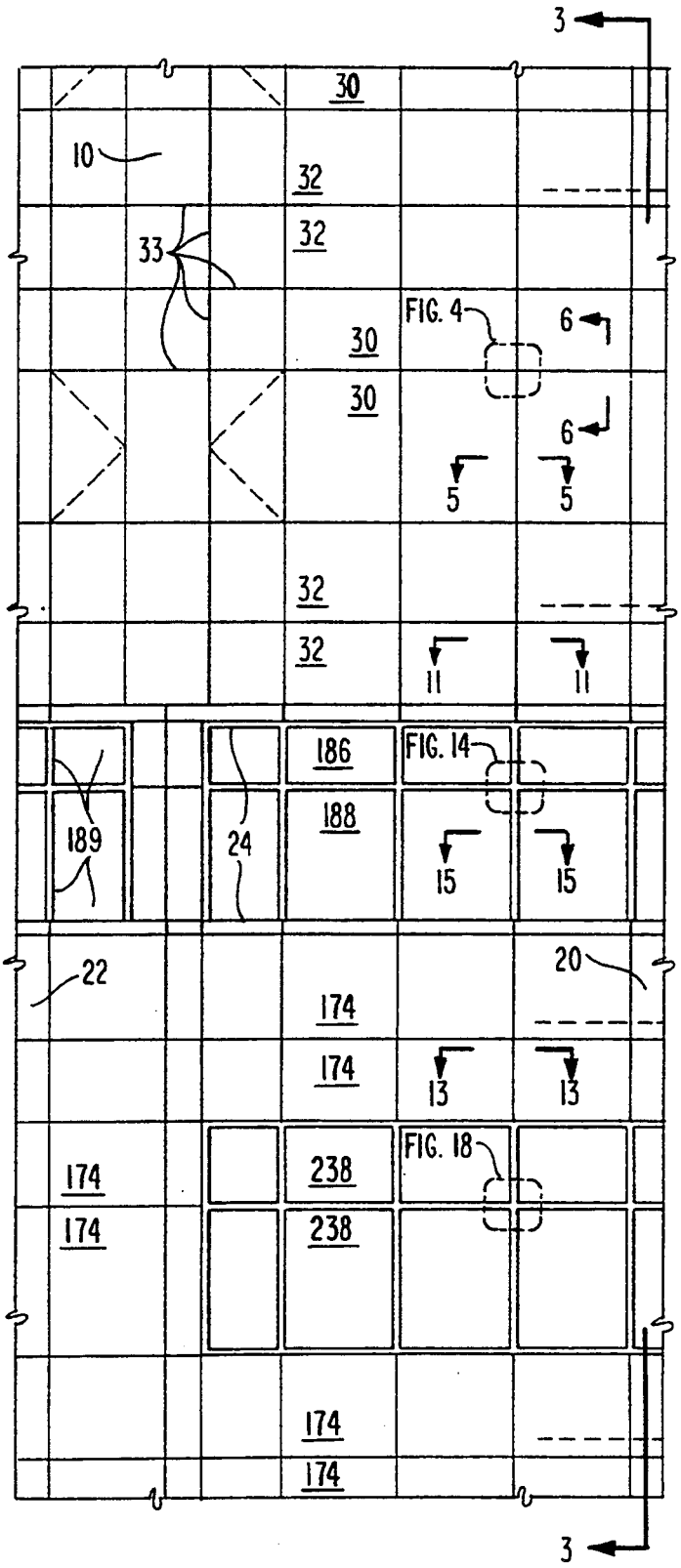
FIG. 2 is a front elevational view of an enlarged central part of the first embodiment of the invention.

FIG. 2 is a portion of FIG. 1 showing the locations of different facade materials. Facade materials can include insulated glass panels 30, single spandrel glass 32, back attached panels 160, edge attached panels 174, dual glazing 238 and exposed members curtainwall 189 or non-exposed members stopless curtainwall. It will be appreciated to those skilled in the art that numerous other facade materials and arrangements of the materials can be used.

Figure 3:
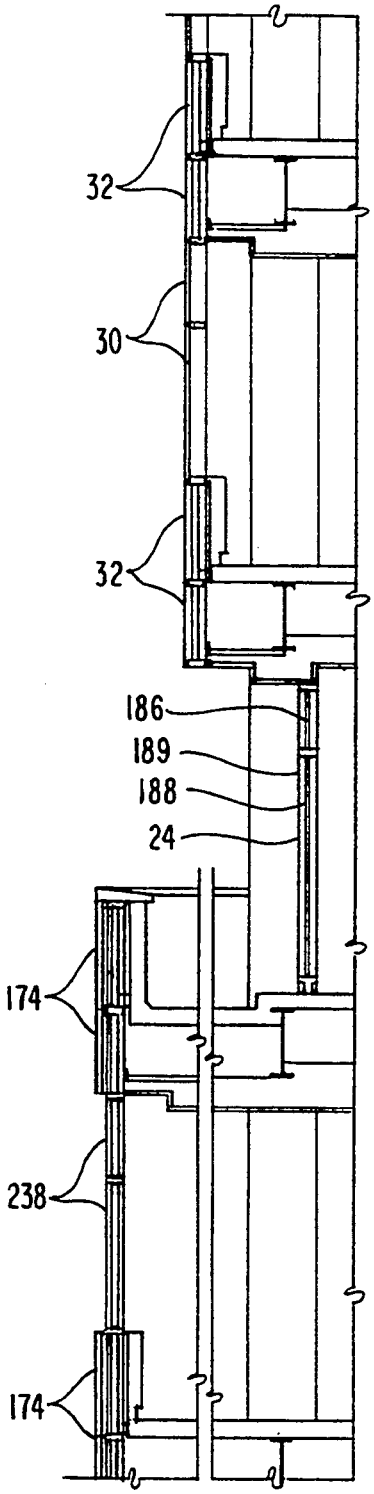
FIG. 3 is a vertical cross-sectional view of the central part of the first embodiment of the invention shown in FIG. 2.

FIG. 3 is a vertical cross-sectional view at the enlarged central area of the front elevational view FIG. 2. Insulated glass panel 186 and spandrel glass panel 188 are recessed from single spandrel glass 32 and insulated glass panels 30.

Figure 4:
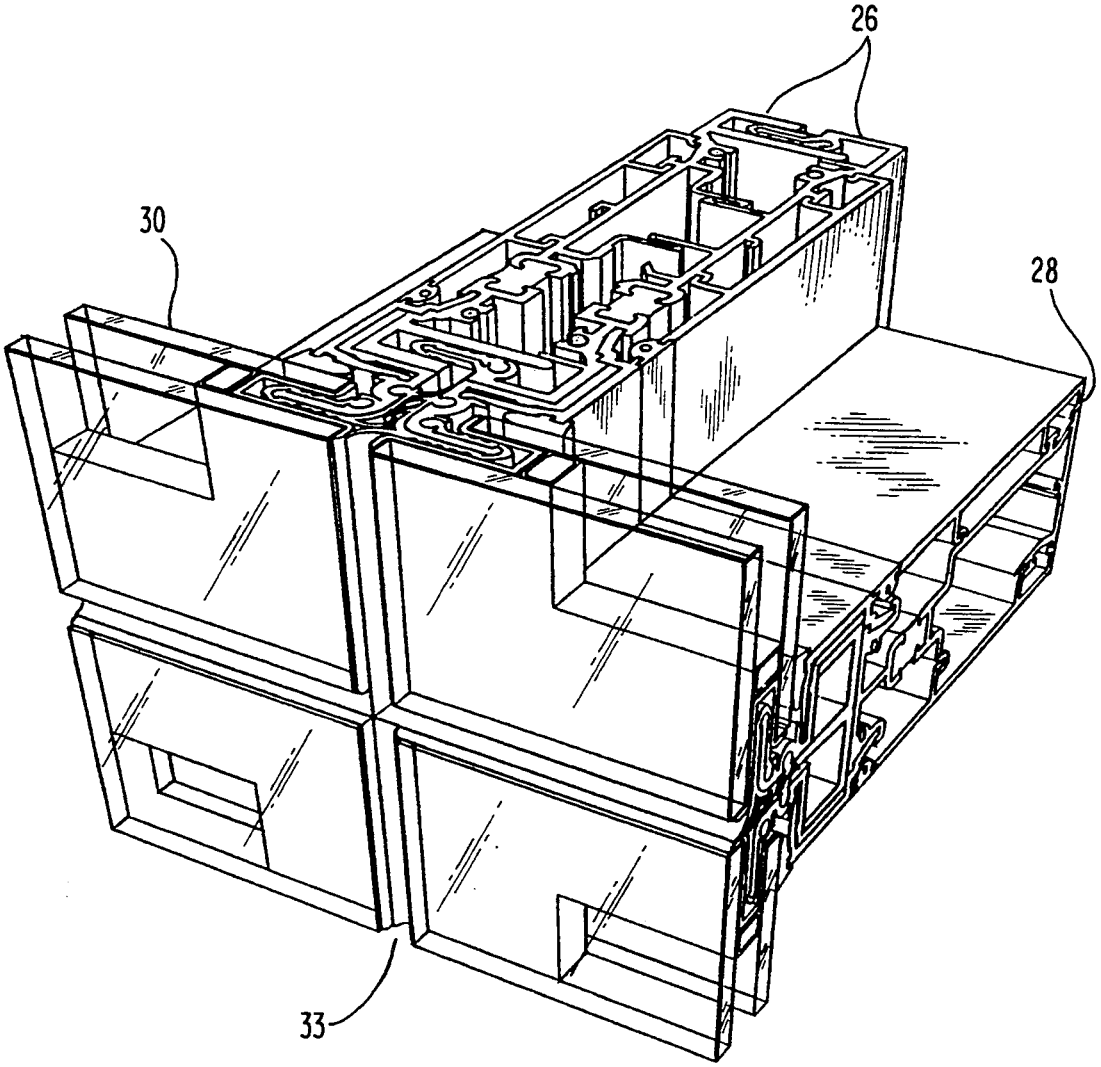
FIG. 4 is a perspective cross-sectional view of a four sided, stopless, butt-joint insulated glass curtainwall according to first embodiment of the present invention.

FIG. 4 illustrates a perspective sectional view at an intersection of a vertical mullion 26 and a horizontal mullion 28. In this first embodiment, the facing panel is insulated glass 30. The graphic impression presented to an observer of the building is of an all glass monolithic facade with four sided stopless butt-joints 33. Insulated glass panels 30 are preferably separated by joint 33, which is a space of between about 0.3 and 0.5 of an inch. Typically, this first embodiment of the curtainwall system is applied in floors of upper blocks 10 and 14.

Figure 5:
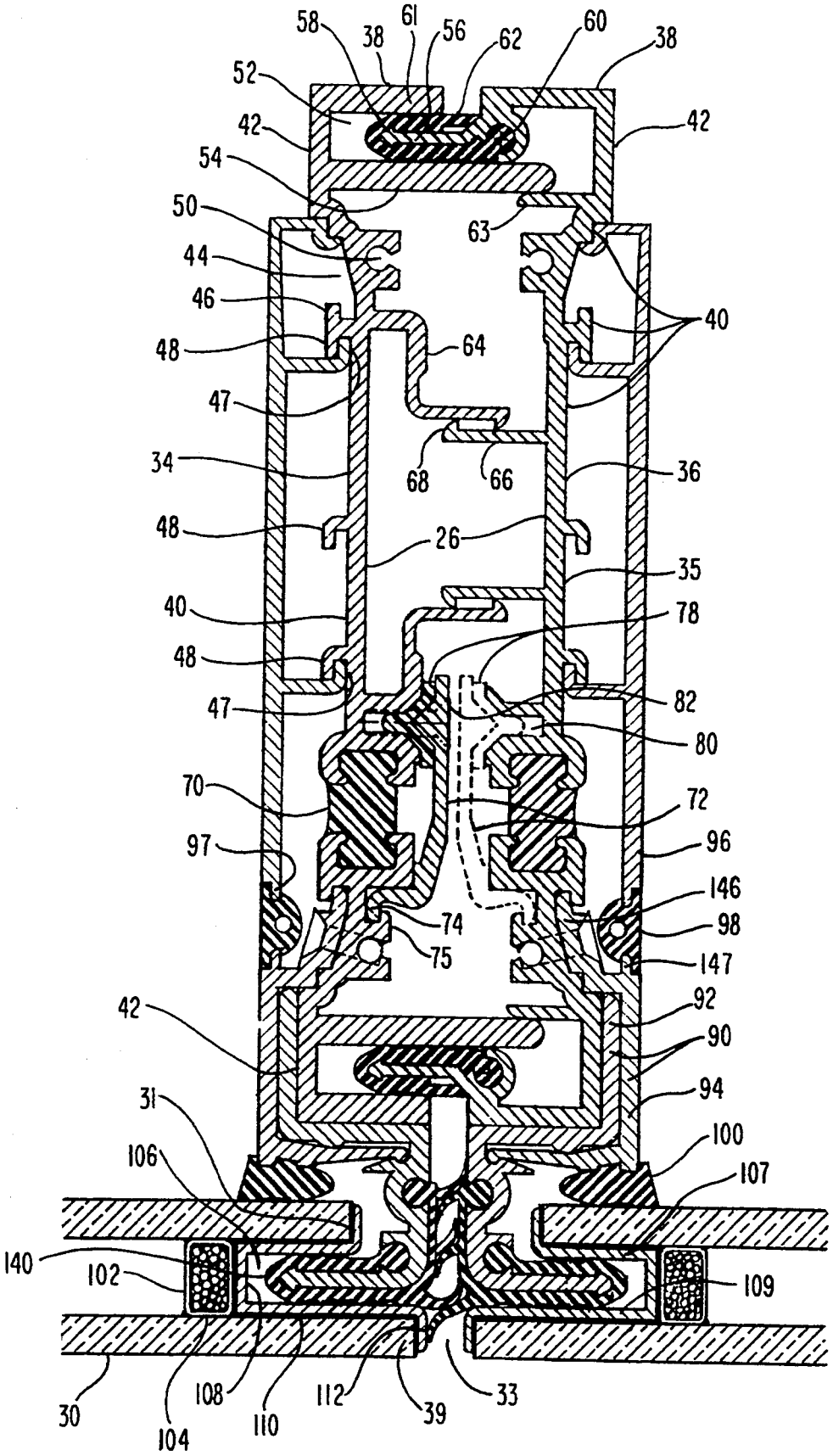
FIG. 5 is a horizontal cross-sectional view of a vertical mullion and retainer clip assembly of the first embodiment of the present invention.

FIG. 5 illustrates a horizontal cross-sectional view through vertical mullion 26. Vertical mullion 26 is a split mullion. Vertical mullion 26 includes interlocking female half 34 and male half 36. Female half 34 is channel shaped with an end flange 38 at each end. Male half 36 is shaped symmetrically to female half 34.

A channel web 35 forms a side of vertical mullion 26 in both the female half 34 and male half 36. Channel web 35 is divided into a middle strip 40 and two side strips 42 in the same plane. Alternatively, middle strip 40 can be in a different plane than side strips 42. Chamber 44 is formed adjacent each end of middle strip 40. Chamber 44 has a sloped back and barb 46. Chamber 44 receives and restrains matching shoe shaped ends 146 of bracket retainer 94. Hook barb 48 protrudes from middle strip 40 for engagement with cover hook barb 47 of cover 96. A screw cavity 50 is positioned at the back of each chamber 44 for attachment to horizontal mullions.

An interlocking cavity 52 is formed between end flange 38 and female flange 54 at each end of female half 34. End flange 38 of male half 36 has a protruding male flange 56. Male flange 56 has a protruding arrow head 58 at one end thereof. Gasket pocket 60 is formed at the base of male flange 56. A wrap around weather gasket 62 is fitted around male flange 56 and interlocks with gasket pocket 60.

Preferably, weather gasket 62 has fluted curved reveals 61 for providing a capillary break and for providing ease of installation of the assembly. A guide flange 63 extends from male half 36 to retain female flange 54 in contact with weather gasket 62. Flanges 64 have a "Z" shape and extend from female half 34 for snapping into locking engagement with flanges 66 which extend from male half 36. Flanges 64 and 66 have barbed ends 68 for securing ab interlocking of the female half 34 with the male half 36.

A thermal break 70 is applied to each mullion half at the middle strip 40 adjacent to the outer side of chamber 44. The size and composition of material for forming the thermal break 70 can vary as known in the art. Thermal break 70 is subjected only to compression stress. Tension stress on thermal break 70 is relieved with relieving clip 72. Relieving clip 72 can be formed of a plurality of about 1.25 inch long clips. Preferably, a minimum of two clips are applied to each mullion half at the same location. In the alternative, the clips can be positioned in staggered locations.

Preferably, relieving clip 72 is used to attach side strip 42 to middle strip 40. Clip 72 preferably has a "Z" shape. Outer side short flange 74 of clip 72 is retained by barb 75 to side strip 42. An inner side long flange 76 is fastened to the inner rear portion of middle strip 40. Flange 76 includes a pointed triangle shape projection to engage with a "Y" shaped premolded thermal break 78 which engages screw reveal 80. Fastener screw 82 penetrates through clip 72 and premolded thermal break 78 for threaded engagement with the side walls of screw reveal 80.

Retainer clip assembly 90 mechanically engages the edge of insulated glass panels 30. Retainer clip assembly 90 secures insulated glass panels 30 to an adjacent male mullion half 36 or female mullion half 34. Preferably, retainer clip assembly 90 is formed of two pieces. Retainer clip assembly 90 includes hook clip 92 which has a substantially C-shaped outer portion as shown in FIGS. 5 and 7–10, and bracket retainer 94. Cover 96 is attached to middle strip 40 with hook barbs 97 and retained by a round-back gasket 98. Wedge gasket 100 is installed between clip retainer assembly 90 and insulated glass panel 30.

Insulated glass panel 30 is preferably formed with a shorter inner glass sheet end 31 than outer sheet end 39. A conventional desiccant spacer strip 102 and primary seal adhesive 104 is used between insulated glass panels 30 for spacing the panels apart, holding them together, and providing weather seals. A deep channel shaped cavity 106 is formed behind spacer strip 102. Glass panels 30 form the sides of the channel shaped cavity 106. An optional lining for cavity 106 is preferably applied including a channel 108 with inner flange 107 shorter than outer flange 109. Inner flange 107 and outer flange 109 have an angled lip 112 which engages glass panels 30. Channel 108 is a structural enhancement for protecting primary seal adhesive 104 against delamination caused by the constant tension stress applied by wrap-around weather gasket 140. Gasket 140 applies constant pressure on the two sides of cavity 106, which spreads apart glass panels 30 and can cause delamination. Angled lip 112 protects against chipping and breaking of the glass panels 30, while providing improved adhesion and seal between the panels. A secondary seal 110 is applied between channel 108 and glass panels 30.

Figure 6:
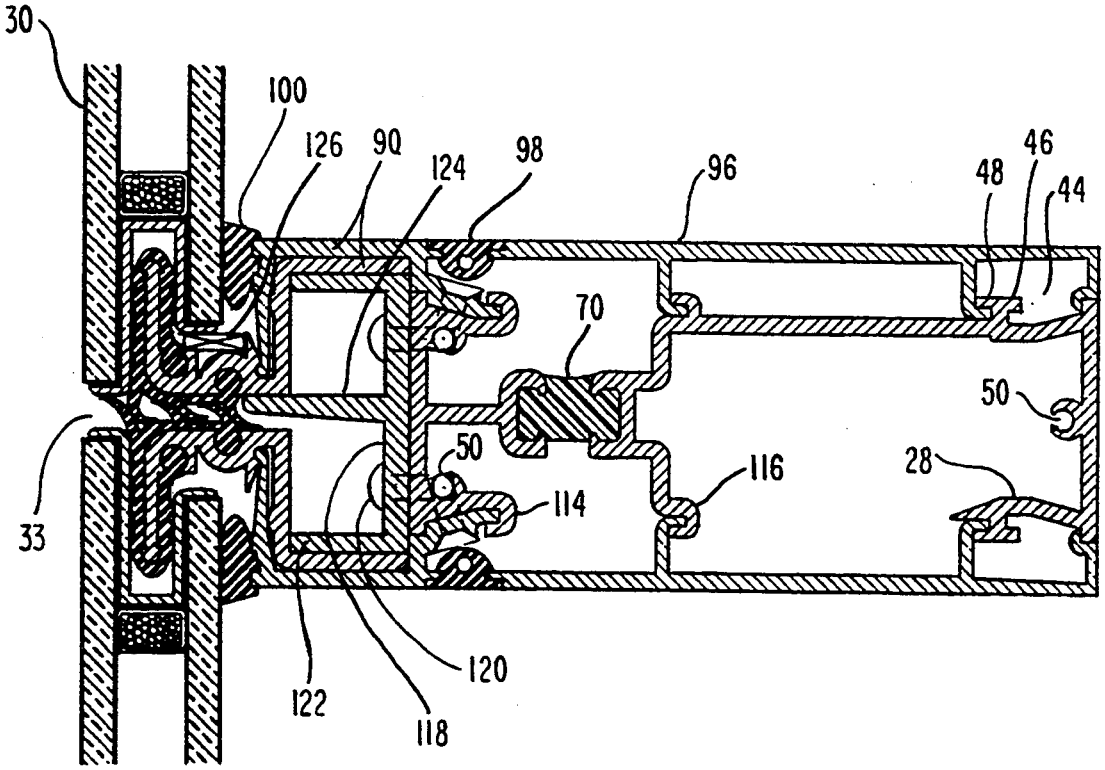
FIG. 6 is a vertical cross-sectional view of a horizontal mullion and retainer clip assembly of the first embodiment of the present invention.

FIG. 6 is a vertical cross-sectional view of horizontal mullion 28. Horizontal mullion 28 is as deep as the middle strip 40 of vertical mullion 26 as shown in FIG. 5. Thermal break 70 connects a "T" shaped front portion 114 to a channel shaped rear portion 116. Chambers 44 with barbs 46 are symmetrically formed at the corners of horizontal mullion 28. Chambers 44 with barbs 46, hook barbs 48 and screw cavities 50 in the horizontal mullion 28 are aligned with similar elements formed in the middle strip 40 of vertical mullion 26.

Horizontal mullion 28 is a cross-member attached to vertical mullion 26 as shown in FIG. 4. Horizontal mullion 28 transmits stress to vertical mullion 26. In a preferred embodiment, horizontal mullion 28 spans about 4 feet and vertical mullion 26 has a vertical span of about 10 feet between connections. The reduced size of horizontal mullion 28 allows the mullion to have a smaller depth aligned with the middle strip 40 at the sides of vertical mullion 26. This reduced size of the horizontal mullion 28 provides reduced costs of materials.

Extension piece 118 is "W" shaped. Extension piece 118 is fastened with screws 120 to the front of horizontal mullion 28. Extension piece 118 has end flanges 122 and central flange shelf 124. Central flange shelf 124 extends horizontally for supporting the gravity load of insulated glass panels 30. Preferably, the bottom edge of panel 30 is supported by setting blocks 126. In the alternative, the bottom edge of panel 30 can be a continuous gasket.

Insulated glass panel 30 is installed to horizontal mullion 28 with retainer clip assembly 90, cover 96, round-back gasket 98 and wedge gasket 100, as described above with respect to the vertical mullion 26.

Figure 7:
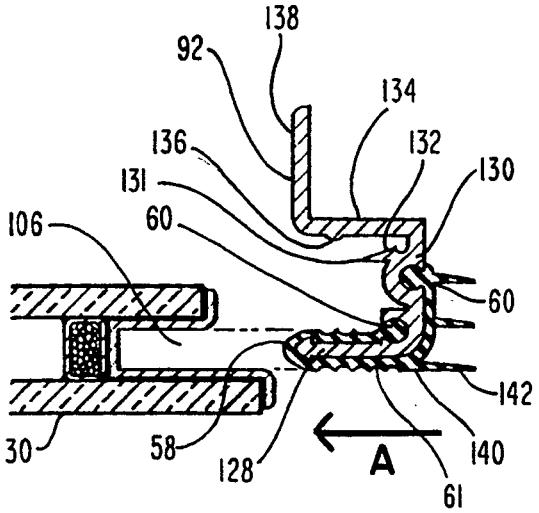
FIG. 7 is a horizontal cross-sectional view of a grooved edge of an insulated glass panel showing installation of a hook clip.

Installation procedures for installing the glass panels are shown in FIGS. 7 through 10. FIG. 7 shows first installation step "A" for installing outer side flange 128 of the hook clip 92 into channel shaped cavity 106. Preferably, hook clip 92 has a sickle shape. Outer side flange 128 is positioned parallel to and faces glass panel 30. Arrow head 58 is formed at one end of outer side flange 128. Gasket pockets 60 are formed on either side of web 130. A guide flange 131 has side barb 132 projecting toward the inside of hook clip 92. Guide flange 131 guides into place and interlocks with bracket retainer 94.

Rear side segment 134 of hook clip 92 is arranged parallel to panel 30. A pointed projection 136 transmits the outward load from hook clip 92 to bracket retainer 94 when the panel is subjected to suction or wind load. Segment 138 of hook clip 92 is arranged perpendicular to panel 30. Segment 138 has the same depth as side strips 42 of vertical mullion 26.

A wrap-around weather gasket 140 is installed around and interlocks with outer side flange 128 and gasket pockets 60. Weather gasket 140 has fluted curved reveals 61 for providing a capillary break. Flexible flange flaps 142 project parallel to panel 30 and extend into joint 33 between adjacent panels 30 to form weather seals for joint 33, as shown in FIGS. 4, 5 and 6.

Figure 8:
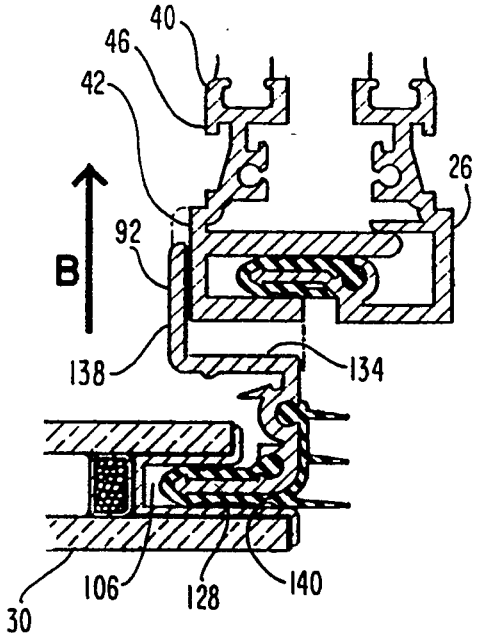
FIG. 8 is a horizontal cross-sectional view of the exterior front portion of the vertical mullion showing installation of the insulated glass panel.

FIG. 8 illustrates movement of panel 30 toward vertical mullion 26 after hook clip 92 is applied, shown as step "B". Panel 30 is urged inward until rear side 134 of hook clip 92 rests against vertical mullion 26. Segment 138 can be adjusted by known manufacturing methods to rest tightly against side strip 42 of vertical mullion 26.

Figure 9:
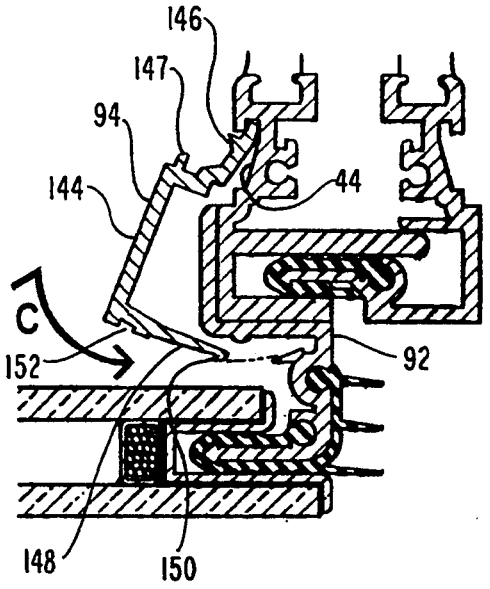
FIG. 9 is a horizontal cross-sectional view of the exterior front portion of the vertical mullion showing installation of a bracket retainer.

As shown in step "C" of FIG. 9, bracket retainer 94 is installed by engaging the tip of shoe end 146 of central web 144 into chamber 44. Barb 147 is formed at inner end of web 144. Outer end of web 144 has a flange 148. Flange 148 has a tapered shape and ends with side barb 150. Reveal 152 is formed to retain wedge gasket 100. In addition, an optional reveal for accommodating screw heads can be formed in the shoe end 146.

Shoe end 146 is restrained by chamber recess 44 with barb 46. Barb 46 anchors bracket retainer 94 against mullion 26 and permits circular movement of bracket retainer 94 to circularly move during installation. The circular movement gradually positions bracket retainer 94 tightly against hook clip 92. Flange 148 of bracket retainer 94 with side barb 150 is guided into a channel of hook clip 92, formed between rear side 134 and guide flange 131, to contact hook clips 92 and to snap-lock in with side barb 132 of guide flange 131. Thus, side barb 150 of flange 148 and guide flange 131 of hook clip 92 act as locking elements. After installation, bracket retainer 94 and hook clip 92 are interlocked and this assembly is restrained to the mullion.

In the case of extreme wind suction, the outward load applied on hook clip 92 by panel 30 is transmitted to bracket retainer 94 at the pointed projection 136 of rear side 134. It is known that load stress causes material strain and any load transmitted to the flange 148 could cause material strain and an outward flexing of the flange 148. The transmission of stress to bracket retainer 94 provides for tighter interlocking between the clip and bracket assembly and control of the deformation of flange 148.

Figure 10:
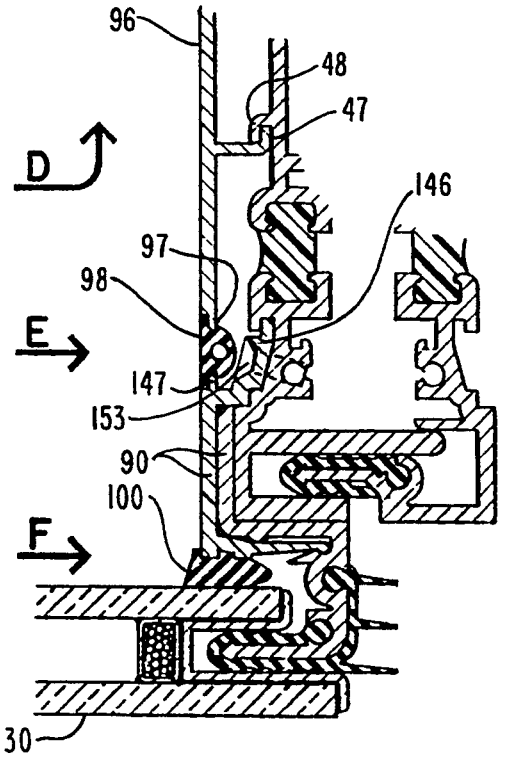
FIG. 10 is a horizontal cross-sectional view of the exterior front portion of the vertical mullion showing the installation of a side cover, optional screws, round back gasket and wedge gasket.

FIG. 10 shows optional screw fasteners 153 installed through an aperture of shoe end 146 for fastening shoe end 146 within a recess of the mullion. Preferably, cover 96 is installed in step "D" by retracting it backward so that cover hook barbs 47 engage with hook barbs 48 of the mullion. Cover 96 is held in place by installing a round back gasket 98, as shown in step "E". The use of round back gasket 98 prevents thermal bridging. Gasket 98 has grooved sides for engaging barb 147 of bracket retainer 94 and hook barb 97 of cover 96.

Wedge gasket member 100 is installed in step "F". Wedge gasket 100 is inserted into the space between flange 148 and the inside face of insulated glass panel 30. Wedge gasket 100 has a protrusion for engaging reveal 152 of flange 148.

Figure 11:
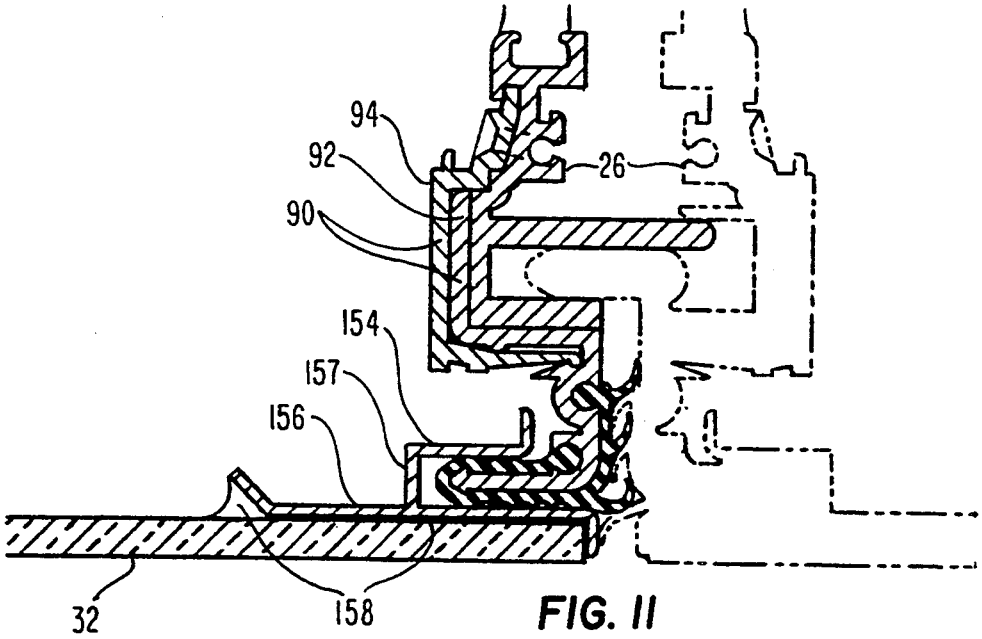
FIG. 11 is a horizontal cross-sectional view of the second embodiment of the present invention with a vertical mullion and an attached single spandrel glass panel.

FIG. 11 is a horizontal cross-sectional view of the exterior front portion of half a vertical mullion 26 and retainer clip assembly 90 in a second embodiment of the present invention. In this embodiment, a single spandrel glass panel 32 is installed with similar installation procedures as shown in FIG. 7 through FIG. 10.

An outer flange 156 is positioned at the end of shaped channel edge 154. Outer flange 156 is extended at the back of spandrel glass panel 32 to form a "T" shape with web 157 of channel 154. A primary seal 158 adheres and weather seals spandrel glass panel 32. In the case of extreme wind suction, the "T" shape prevents the corner of channel, where web 157 meets outer flange 156 from peeling away from spandrel glass panel 32 since the load is transmitted to bracket retainer 94. Channel edge 154 is similar to channel 108.

Figure 12:
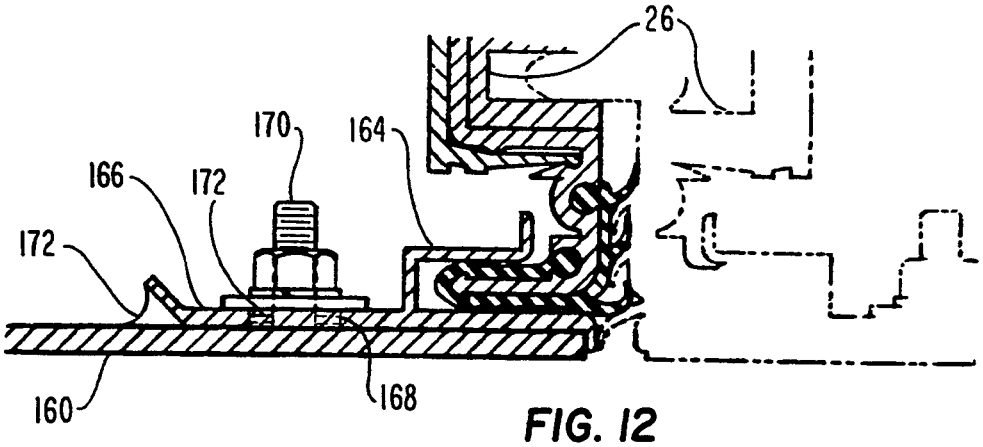
FIG. 12 is a horizontal cross-sectional view of the third embodiment of the present invention with a vertical mullion and a back attached facing panel.

FIG. 12 is a horizontal cross-sectional view of the exterior front portion of half a vertical mullion 26 and retainer clip assembly 90 in a third embodiment. Back attached panel 160 is installed with similar installation steps shown in FIG. 7 through FIG. 10.

Preferably, back attached panel 160 can be applied at an elevator shaft vertical enclosure strip 162 which is part of upper right wing block 14. In this embodiment, enclosure strip 162 is positioned above the roof of lower base block 20 and extends to the roof of utility rooms 18. Back attached panel 160 can also be applied at a parapet wall and spandrel area at the roof of top floors 12 and 16 and at the utility room 18.

Back-attached facing panel 160 is preferably a thick gauge aluminum sheet of about 0.125 to 0.188 inch thick. Channel edge 164 has an extended flange 166. Preferably flange 166 has oversized holes 168 for receiving aluminum welded studs 170. Back-attached facing panel 160 is weather sealed with caulking 172 between the back-attached facing panel 160 and edge 164. Channel edge 164 is similar to channel edge 108 and 154.

Figure 13:
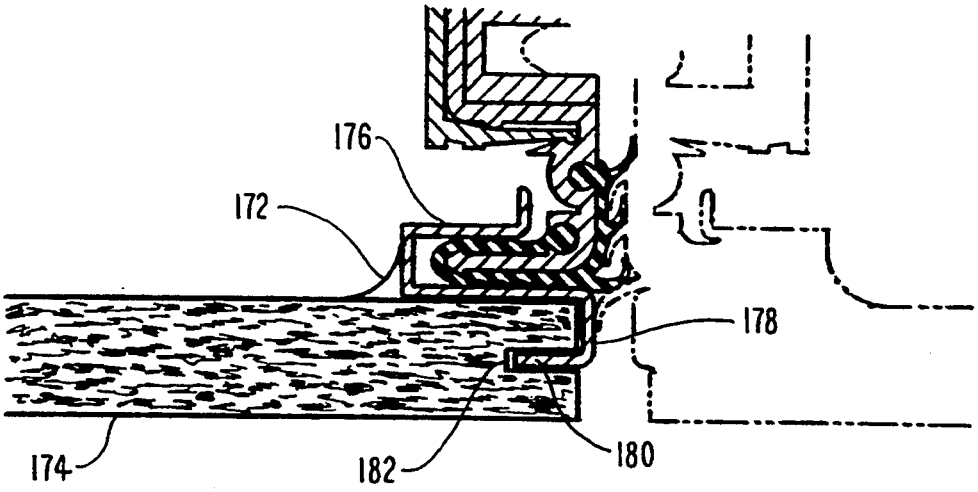
FIG. 13 is a horizontal cross-sectional view of the fourth embodiment of the present invention with a vertical mullion with an edge attached facing panel.

FIG. 13 is a horizontal cross-sectional view of a fourth embodiment of the present invention with an edge-attached facing panel 174. Edge-attached facing panel 174 is preferably used in the lower base block 20 and its projected left portion 22 of the curtainwall system. Edge-attached facing panel 174 is preferably a granite panel about 0.75 inch thick. Edge flange 176 has an outer angled lip to form an edge cap 178. An engaging flange 180 engages with a matching groove 182 formed in the granite panel edge.

Preferably engaging flange 180 and groove 182 are formed continuously as shown. In the alternative, engaging flange 180 can be formed in a plurality of small length pieces of at least two pieces per side or as studs integrated with the extended panel edge cap 178 for engaging drilled holes at an edge of granite panel. Edge-attached facing panel 174 is weather sealed with caulking 172.

The engagement of the panel in a channel shaped space engagement allows for thermal expansion and manufacturing tolerances. The channel shaped space can be coordinated with the panel manufacturer so as to be an integral part of panel construction. In the alternative, the channel shaped space can be attached as a separate formed edge. Channel shaped space can be made of extruded or bent metal having a one piece or multiple piece construction. The exact shape of channel shaped space and formed edge can be determined by the method of attachment. This attachment method is determined from the factors of panel thickness, weight, area, material, applicable production tooling and the panel construction. In the alternative, the panels can be made of insulated tempered glass, laminated glass, single spandrel glass, glass, metal, plastic, acrylic, granite, marble, natural or man made materials. The panels can be single, multiple or composite construction including a foam core and thermal insulation panels.

Figure 14:
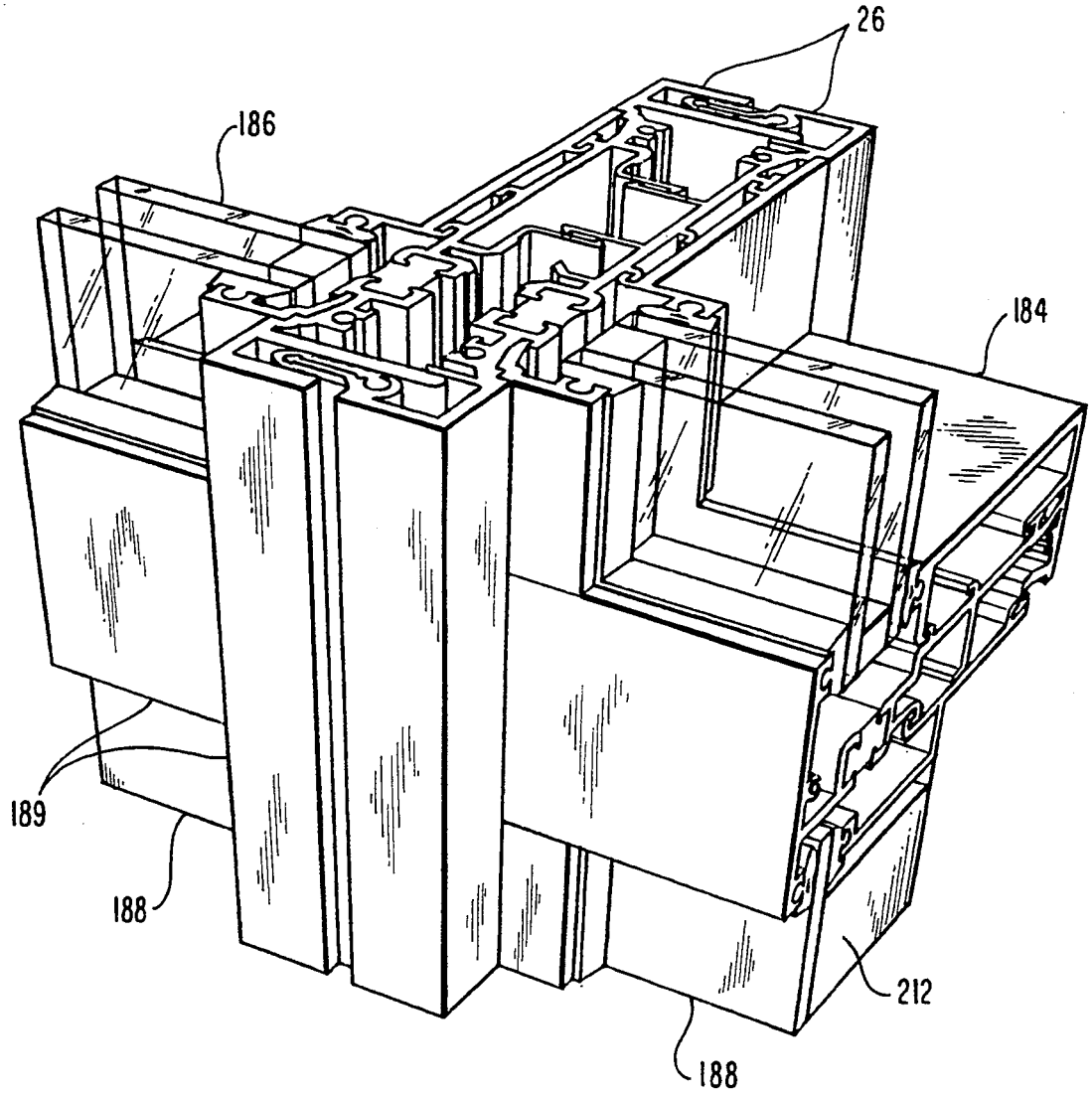
FIG. 14 is a perspective cross-sectional view of the fifth embodiment of the present invention with an exposed curtainwall grid members having insulated glass panels and single spandrel glass panels with a back attached thermal insulation board.

FIG. 14 is a perspective partial cross-sectional view of an intersection of vertical mullion 26 and central horizontal mullion 184 of a fifth embodiment of the present invention. Panel 186 is formed of insulated glass and panel 188 is formed of spandrel glass with back-attached thermal insulation board 212. The graphic impression to the observer is that of an exposed members curtainwall 189. The face of vertical mullion 26 is projected more than horizontal mullion 184. Horizontal mullion 184 is preferably formed to be the same width as the middle strip 40. Horizontal mullion 184 is similar to previously described horizontal mullion 28.

Preferably, an exposed members curtainwall system 189 is applied at: recessed floor 24 between lower base block 20 and wing blocks 10 and 14; at recessed top floors 12 and 16; and at the vertical recessed strip 192 of upper block 14. Recessed strip 192 connects floor 24 with top floor 16.

Figure 15:
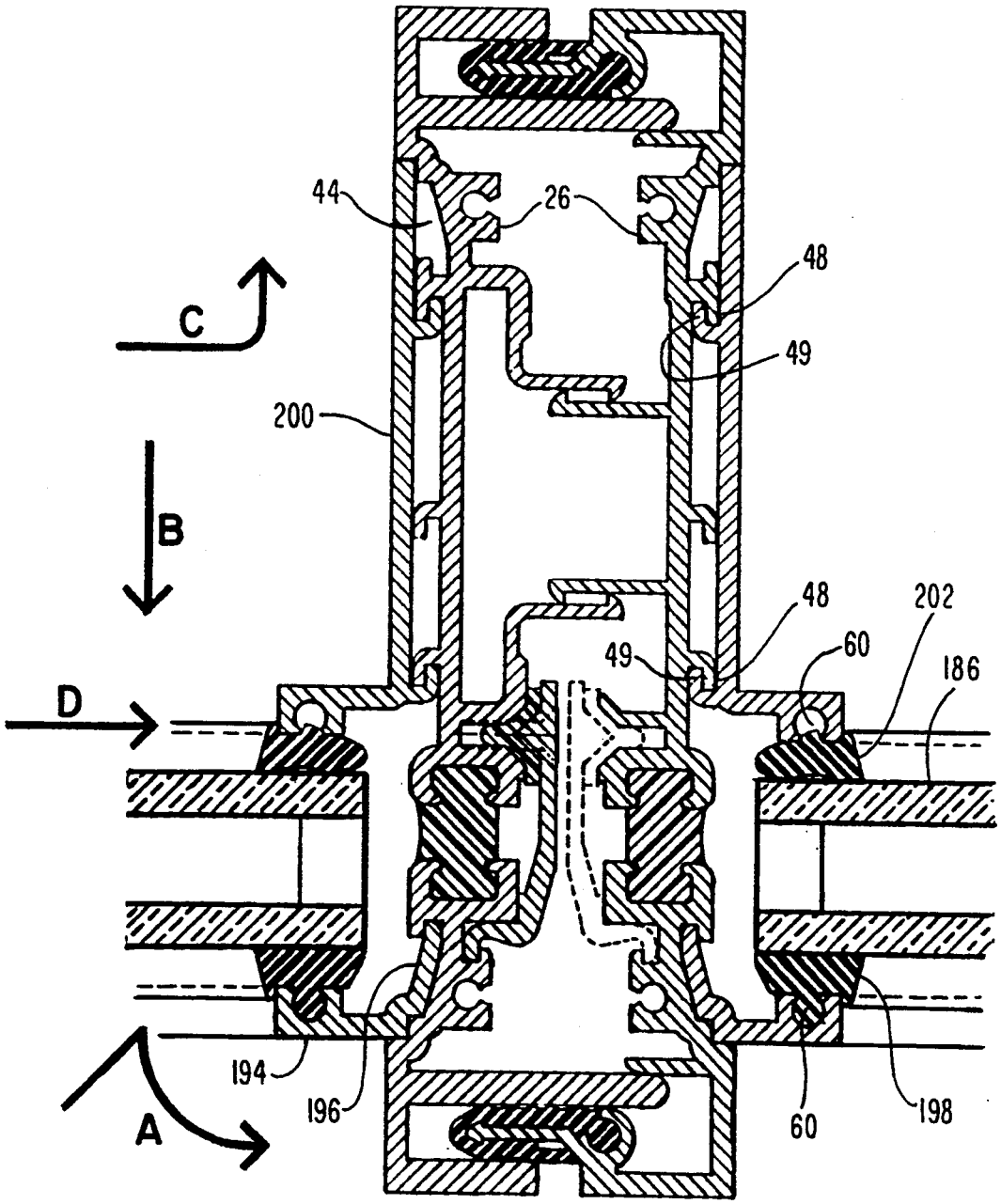
FIG. 15 is a horizontal cross-sectional view of the vertical mullion of the fifth embodiment of the present invention shown in FIG. 14.

FIG. 15 illustrates a horizontal cross-sectional view through vertical mullion 26 of exposed members curtainwall 189 shown in FIG. 14. In step "A", outer side retainer 194 is installed. Outer side retainer 194 is angle shaped, and is restrained in chamber 44 with shoe shaped side 196. Outer side retainer 194 has a glazing gasket 198 installed in gasket pocket 60. Insulated glass panel 186 is installed, in step "B", from the inside of the building by moving the panel in an outward direction until it rests against glazing gasket 198. Bracket retainer 200 is angle shaped and is installed, in step "C", by hooking it in place with a retracting movement. Inward barbs 49 engage with matching barbs 48 of the mullion. Wedge gasket 202 is installed in step "D" by inserting it into the space between retainer 200 and the inner face of insulated glass panel 186. Wedge gasket 202 has a protrusion for engaging the gasket pocket 60 of retainer 200.

Figure 16:
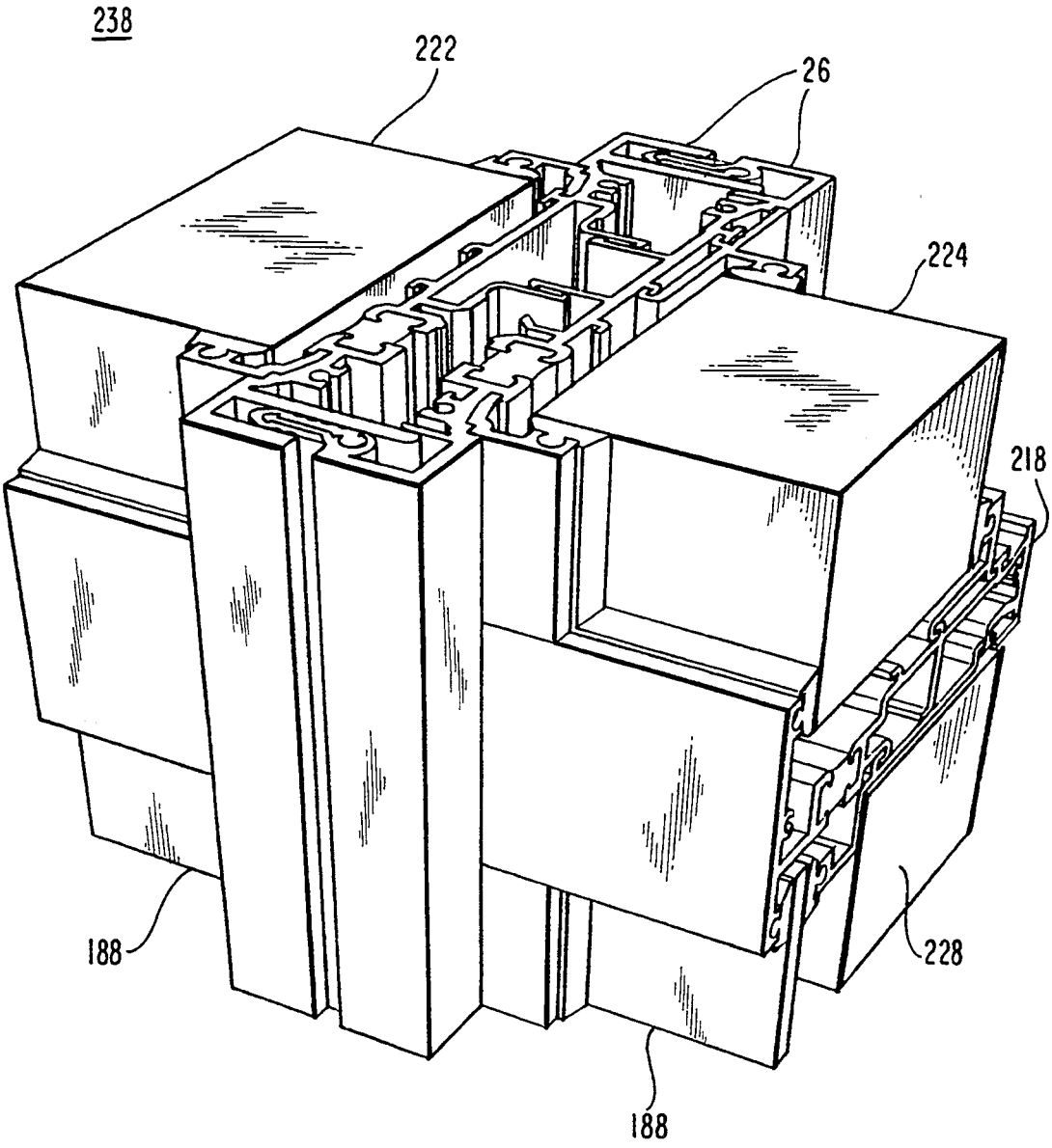
FIG. 16 is a perspective cross-sectional view of a sixth embodiment of the present invention having a curtainwall system with different thickness of infill panels and single spandrel glass panels with thermal insulation board in an alternative location.

FIG. 16 is a perspective cross-sectional view showing an intersection of a vertical mullion 26 and the central horizontal mullion 218 in a sixth embodiment of the present invention. This embodiment is used in units 220 shown in FIG. 1. Unit 220 is preferably three panels wide and two tiers high. The facing panel adaptions in this embodiment are of different thickness infills 222 and 224 and spandrel glass panel 188. A rigid thermal insulation board 228 is installed in the alternative location, behind spandrel glass panel 188 and with a space cavity in between insulation board 228 and spandrel glass panel 188. This exposed members curtainwall 189 is similar to FIG. 14, but with different thickness infills. Bracket retainers similar to bracket retainers 94, 194 and 200 can be used to attach infills 222 and 224, and spandrel glass 188 with insulation board 228.

Figure 17:
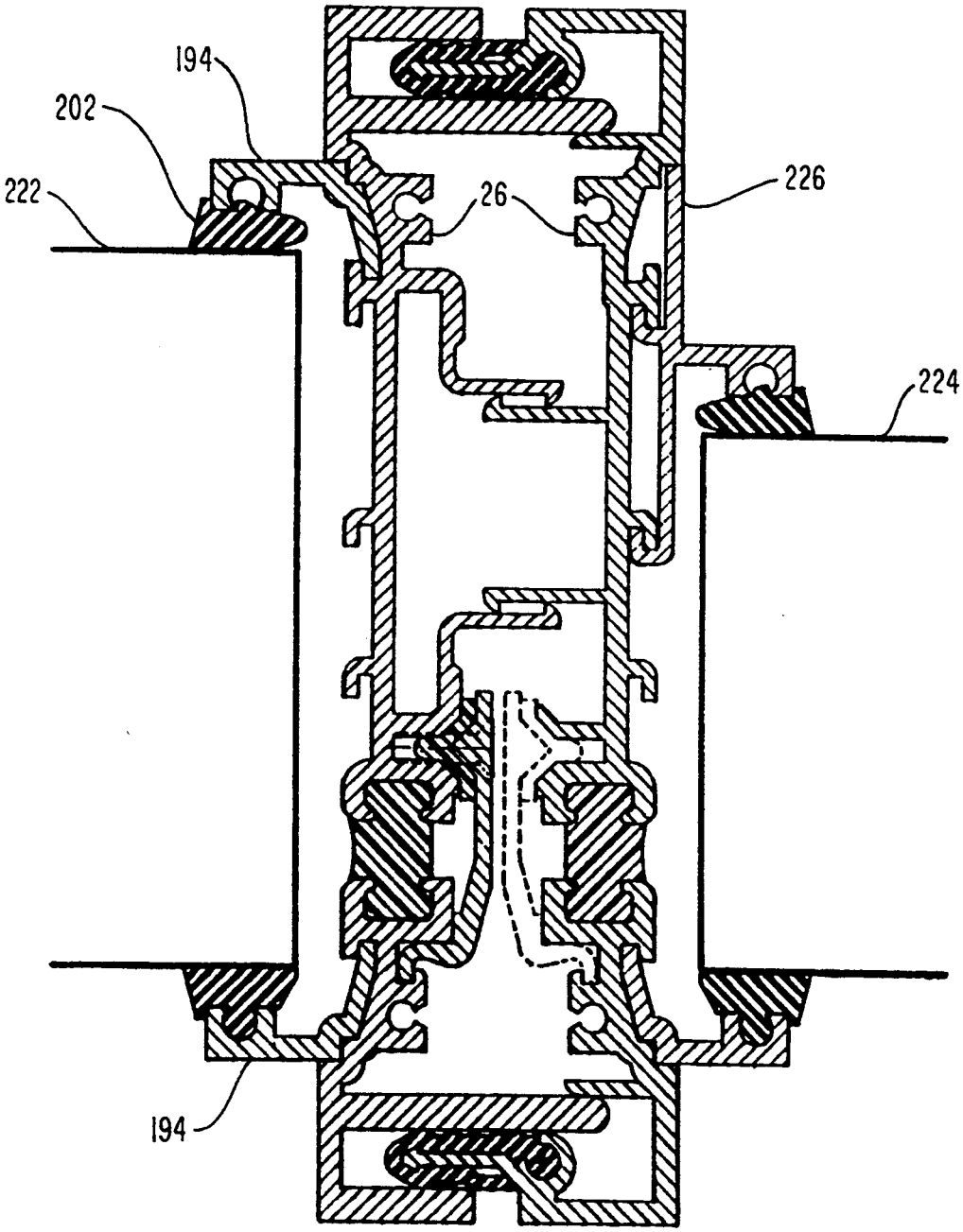
FIG. 17 is a horizontal cross-sectional view of the vertical mullion of the sixth embodiment of the present invention as shown in FIG. 16.

FIG. 17 illustrates a horizontal cross-sectional view through vertical mullion 26 shown in FIG. 16. Infill 222 is a framed operable window. Infill 224 is a framed louver grill. Infill 222 is preferably with a deeper frame than infill 224. Retainer clip assembly 194 and 226 are installed with steps similar to the steps shown in FIG. 15. Wedge gasket 202 is inserted between retainer clip assembly 194 and 226 and panels 222 and 224.

Figure 18:
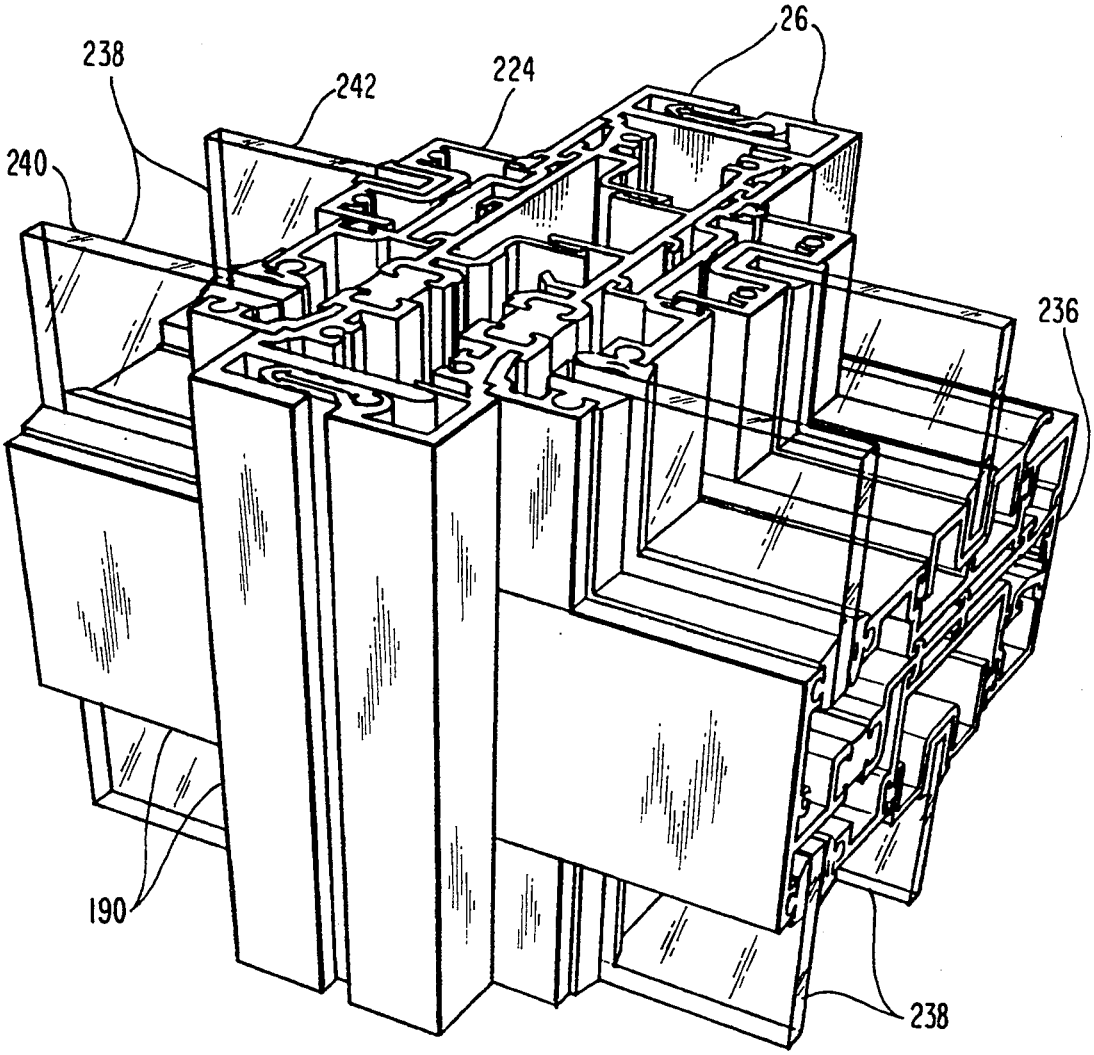
FIG. 18 is a perspective cross-sectional view of a seventh embodiment of the present invention having a curtainwall system with dual glazing.

FIG. 18 illustrates a pictorial perspective sectional view of a seventh embodiment showing an intersection of a vertical mullion 26 and a horizontal mullion 236. Facing panel adaptation in this embodiment is dual glazing 238. This exposed members curtainwall 190 is similar to FIG. 14 and FIG. 16.

Dual glazing 238 is preferably applied at the vision area of the first floor and at the second floor in the horizontal central strip of lower base block 20. Dual glazing 238 is composed of an outer side clear acrylic sheet 240 and an inner side laminated glass sheet 242 which is independently framed in a demountable frame 244. Horizontal and vertical mullions which are similar to respective mullions 26 and 28 can be shaped to receive the dual glazing.

Figure 19:
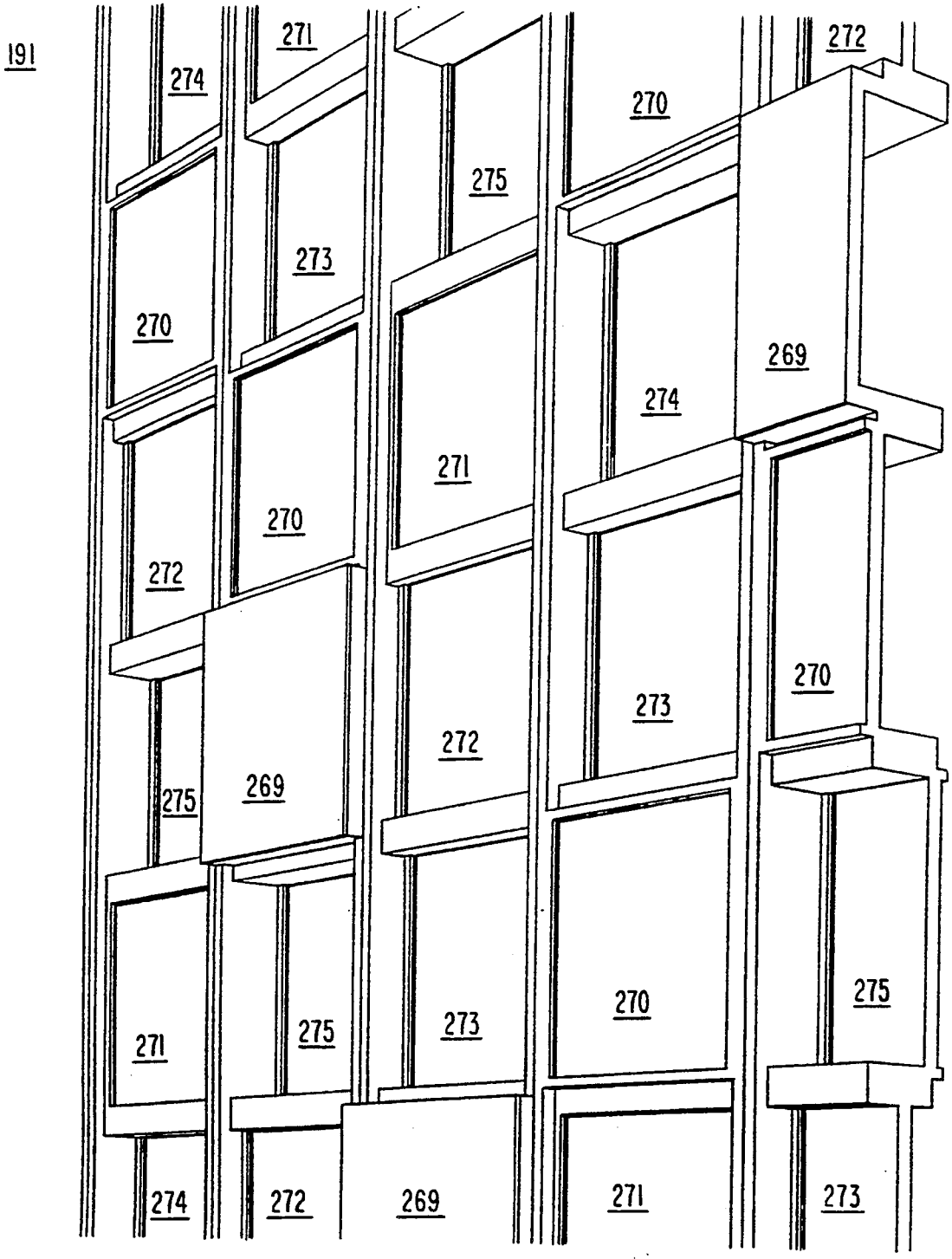
FIG. 19 is a perspective cross-sectional view of an eighth embodiment of the present invention having a curtainwall system with an irregular geometric impression of different facing panels and different face planes.

FIG. 19 illustrates an eighth embodiment of the present invention of a perspective sectional view showing exposed curtainwall 191, which is similar to FIGS. 14, 16 and 18. Insulated glass panels are used in seven different face planes to provide an irregular geometric impression for curtainwall 191. Preferably, curtainwall 191 is used in an open atrium in a building.

Outer face plane 269 is an insulated glass panel 30. Insulated glass panel 30 is installed as shown in FIG. 7 through FIG. 10.

Typically vertical mullion 26 and horizontal mullion 28 form the grid members for supporting the glass panels 30 as shown in FIG. 4 through FIG. 10. Retainer clip assembly 90 is modified to receive each of the different shaped inside and outside glazing retainers for each face plane. Vertical mullion 26 and horizontal mullion 28 receive retainer clip assembly 90 for each face plane. Retainer clip assembly 90 is installed at the four sides of each panel.

Outer face plane 269 is preferably positioned about 1.5 inches in front of vertical mullion 26 and overlaps about half of the mullions at the four sides of panel 30. Face panels 270, 271, 272, 273, 274 and 275 are preferably conventional insulated glass panels having an average of about one inch spacing between each of the face planes. Glazing and installation of retainers, covers and gaskets is similar to FIG. 15.

The irregular impression created by the different face planes will be enhanced by the daylight shades and sun cast shadows. The reflective face of the glass panels creates a different mirror image for exposed mullion side wall at the different recessed face planes. In the alternative, glass, facing panel or infills of different materials can be used. The impression is formed in at least two face planes and in any graphic or geometric arrangement.

Figure 20:
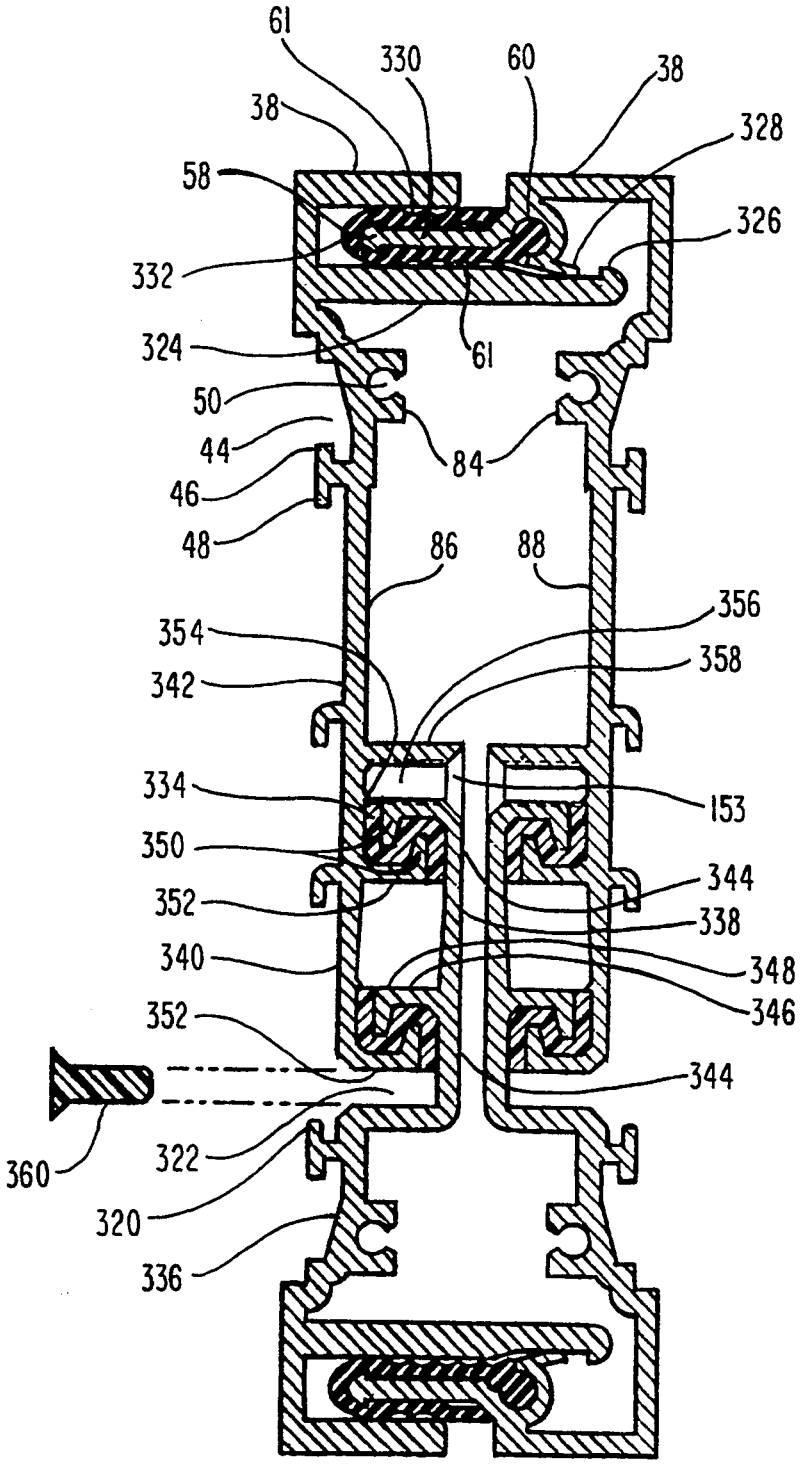
FIG. 20 is a horizontal cross-sectional view of an alternative vertical mullion including an alternative form of thermal break.

FIG. 20 illustrates a horizontal cross-sectional view through vertical mullion 84. Vertical mullion 84 is an alternative for vertical mullion 26. Vertical mullion 84 has interlocking female half 86 and male half 88 which are symmetrically shaped. Chamber 44 having barbs 46, screw cavity 50 and hook barbs 48 is similar to vertical mullion 26, shown in FIG. 5. An extra hook barb 320 and cavity 322 are formed at the side of the female half 86 and male half 88.

The female flange 324 of female half 86 has a rounded end with side barb 326. Side barb 326 snaps into interlocking engagement with fin 328 of male half 88. Extended male flange 330 of male half 88 includes an arrow head end 58, wrap around weather gasket 332 with fluted curved reveals 61.

In this alternative, the integrated structural thermal break 70 formed in each shell of female half 34 and male half 36 of vertical mullion 26 is replaced with premolded thermal break spacers 334. Thermal break spacers 334 preferably have an "S" shape with the segments of the spacer 334 subjected only to compression stress. Thermal break spacers 334 are positioned between the two interlocking portions of each male half 88 and female half 86.

An exterior front portion 336 of female half 86 has an inner end flange 338 extending inward and parallel to the mullion. Flange 340 extends outward from an interior rear portion 342 of female half 86. Front portion 336 and rear portion 342 are mechanically restrained with respect to each other at two connection points 344 for improving rigidity.

Exited from inner end flange 338 is a pair of channel hook shapes 346. A perpendicular web 348 connects to a tapered flange lip 350 to form the short side of the hook shape 346. Flange 340 of rear portion 342 has a pair of channel hook shapes 352 similar to and positioned opposite of hook shapes 346.

Front portion 336 and rear portion 342 of female half 86 are assembled by engaging one side of the "S" shaped premolded thermal break spacer 334 with the matching tapered flange lip 350, of rear portion 342. In a first step, spacer 334 is urged inward until it passes barb 354 and snaps in place inside and around hook shapes 352.

In a second step, front portion 336 is retracted outwardly so that channel hook shape 346 engage matching shaped cavities at the other side of "S" shaped spacers 334. After urging the front portion 336 in place, front portion 336 is locked in place by driving screws 153 into cavity 356 between channel hook shape 346 and flange 358. Screws 153 have threaded engagement at the two side walls of cavity 356, as shown in dotted line.

In the alternative, front portion 336 and rear portion 342 are interlocked by inserting a premolded thermal break wedge 360 into cavity 356. Cavity 322 is similar to cavity 356. In alternative modifications either of the cavities can receive screws, wedges or both.

An alternative to using the premolded wedge 360 is to use a cast-in-place continuous thermal break wet application. The cast in place wet application can be applied in either cavities 356 and 322 or both, which provides an integrated structural performance, between front portion 336 and rear portion 342.

It will be appreciated that screws 153, wedge 360 and thermal break spacer 334 can be formed in plurality of small length pieces of at least two pieces per connection point for each mullion half.

While the invention has been described with reference to the preferred embodiment, this description is not intended to be limiting. It will be appreciated by those of ordinary skill in the art that modifications may be made without departing from the spirit and scope of the invention.

I claim:

1. A system adapted to secure at least one panel to a mullion, the system comprising:

a clip secured to the at least one panel, the clip forming a channel and including a locking element; and a retainer secured to the mullion, the retainer comprising 1) a flange inserted into the channel of the clip, and 2) a locking element disposed on the flange;

wherein the retainer flange is snap-locked within the channel to secure the at lest one panel to the mullion.

2. The system of claim 1, wherein the clip locking element comprises a guide flange and the retainer flange locking element comprises a barb, further wherein as the retainer flange is inserted into the channel, the barb slides along and snaps behind the guide flange to lock the retainer flange within the channel.

3. The system of claim 1, wherein the clip directly contacts the mullion and the retainer flange.

4. The system of claim 1, wherein:

the retainer comprises a central web extending substantially perpendicularly to the retainer flange;

the clip comprises first and second segments extending substantially perpendicularly to each other; and the first and second clip segments are substantially parallel to the retainer central web and the retainer flange respectively.

5. The system of claim 1, wherein the retainer includes an end inserted into a recess of the mullion.

6. The system of claim 5, wherein the retainer end includes an aperture extending therethrough, the system further comprising a fastener disposed within the aperture to secure the retainer end within the mullion recess.

7. The system of claim 1, further comprising a cover adapted for covering the mullion, the cover being secured over the mullion by a gasket disposed between the cover and the retainer.

8. The system of claim 7, wherein the cover and retainer each include a barb, and wherein the gasket has grooved sides that engage the cover barb and the retainer barb to secure the cover over the mullion.

9. The system of claim 1, further comprising a wedge member inserted into a space between the at least one panel and the retainer, wherein the wedge member urges the retainer toward the mullion as the wedge member is inserted into the space.

10. The system of claim 1, wherein the clip includes a projection that engages the retainer and transfers load forces to the retainer from the clip.

11. The system of claim 1, wherein the clip includes a substantially C-shaped portion.

12. The system of claim 11, wherein the C-shaped portion of the clip includes at least one gasket pocket that receives a gasket wrapped around at least part of the C-shaped portion.

13. The system of claim 12, wherein the at least one panel comprises two shaped panels, and wherein part of the C-shaped portion of the clip extends into a channel-shaped opening between the panels.

14. A curtainwall system adapted to secure at least one building panel to a building, the system comprising:

a mullion disposed within the building;

a retainer secured to the mullion;

a clip secured to the at least one panel and adapted to receive the retainer; and a wedge member inserted into a space between the at least one panel and the retainer, wherein as the wedge member is inserted into the space, the wedge member urges the retainer toward the clip to press the clip between the retainer and the mullion, thereby securing the clip to the mullion to secure the building panel to the building.

15. The system of claim 14, wherein a first side of the wedge member contacts a surface of the at least one panel and a second side of the wedge member opposite the first side contacts a surface of the retainer, wherein the wedge member urges the retainer surface and the panel surface away from each other.

16. The system of claim 14, wherein the mullion comprises male and female sections, a portion of the male section being received within a portion of the female section.

17. The system of claim 14, wherein the mullion comprises inner and outer portions, the inner portion being spaced from the outer portion by at least one thermal break.

18. The system of claim 17, further comprising at least one relieving clip connected to and disposed between the inner and outer portions of the mullion, the at least one relieving clip relieving tension stress applied to the thermal break by the inner and outer mullion portions.

19. A method of securing at least one panel to a mullion to form a curtainwall system, the method comprising the steps of:

securing a clip to the at least one panel, the clip forming a channel and including a locking element;

securing a retainer to the mullion, the retainer including a flange having a locking element;

inserting the retainer flange into the channel of the clip so that the retainer flange locking element and the clip locking element engage each other; and snap-locking the retainer flange within the channel of the clip to secure the at least one panel to the mullion.

20. The method of claim 19, wherein:

the clip locking element comprises a guide flange and the retainer flange locking element comprises a barb;

the inserting step comprises the step sliding the barb along the guide flange; and the snap-locking step includes the step of snapping the barb behind the guide flange.

21. The method of claim 19, wherein the step of securing the retainer to the mullion comprises the step of inserting an end of the retainer into a recess of the mullion, and the step of inserting the retainer flange into the channel of the clip includes the step of pivoting the retainer about the end of the retainer inserted into the mullion recess.

22. The method of claim 21, further comprising the step of fastening the end of the retainer within the mullion recess after the retainer flange is inserted into the channel of the clip.

23. The method of claim 19, further comprising the step of inserting a wedge member into a space between the at least one panel and the retainer, the wedge member urging the retainer toward the mullion as the wedge member is inserted into the space.

24. The method of claim 19, wherein:

the mullion is disposed in a building and the at least one panel is a building panel; and the inserting and snap-locking steps are effected from a position inside the building.

* * * * *